US010910721B2

(12) United States Patent
Pan et al.

(10) Patent No.: US 10,910,721 B2
(45) Date of Patent: Feb. 2, 2021

(54) SIMPLE AND COMPACT FILTERING DIELECTRIC RESONATOR ANTENNA

(71) Applicant: South China University of Technology, Guangzhou, Guangdong (CN)

(72) Inventors: Yong-Mei Pan, Guangdong (CN); Pengfei Hu, Guangdong (CN); Kwok Wa Leung, Guangdong (CN); Xiuyin Zhang, Guangdong (CN)

(73) Assignee: South China University of Technology, Guangzhou (CN)

( * ) Notice: Subject to any disclaimer, the term of this patent is extended or adjusted under 35 U.S.C. 154(b) by 303 days.

(21) Appl. No.: 16/021,008

(22) Filed: Jun. 27, 2018

(65) Prior Publication Data

US 2019/0341695 A1 Nov. 7, 2019

(30) Foreign Application Priority Data

May 4, 2018 (CN) ..... 2018 1 0421269

(51) Int. Cl.
*H01Q 9/04* (2006.01)
*H01P 1/208* (2006.01)
*H01Q 25/02* (2006.01)

(52) U.S. Cl.
CPC ..... *H01Q 9/0485* (2013.01); *H01P 1/2084* (2013.01); *H01Q 25/02* (2013.01)

(58) Field of Classification Search
CPC ..... H01Q 9/0485; H01P 1/2084
See application file for complete search history.

(56) References Cited

U.S. PATENT DOCUMENTS 8,928,544 B2 * 1/2015 Massie ..... H01Q 1/243 343/769
10,361,487 B2 * 7/2019 Rashidian ..... G03F 7/40
10,381,735 B2 * 8/2019 Miraftab ..... H01Q 21/061
2012/0212386 A1 * 8/2012 Massie ..... H01Q 9/0492 343/850
2014/0327597 A1 * 11/2014 Rashidian ..... H01Q 1/50 343/905
2015/0207234 A1 * 7/2015 Ganchrow ..... H01Q 9/30 343/893
2016/0322708 A1 * 11/2016 Tayfeh Aligodarz ..... H01Q 21/06
2017/0271772 A1 * 9/2017 Miraftab ..... H01Q 21/061
2019/0252753 A1 * 8/2019 Ashida ..... H01P 11/007

* cited by examiner

*Primary Examiner* — Hasan Z Islam

(57) ABSTRACT

A simple and compact filtering dielectric resonator antenna comprising: a ground plane, a dielectric substrate defined on the ground plane, a dielectric resonator defined on the dielectric substrate, and a hybrid feeding line, the hybrid feeding line comprises: a microstrip line and a metallic conformal strip, and the microstrip line comprises: a microstrip main branch, a first microstrip stub and a second microstrip stub. In the present invention, a hybrid feeding line is firstly employed to a dielectric resonator antenna. It has been shown that this hybrid feeding line can not only increase the impedance bandwidth of the passband but also can introduce two radiation nulls right near the band edges. Both good filtering and radiating performances are therefore obtained without any extra filtering circuit, giving a very compact structure.

4 Claims, 5 Drawing Sheets

SIMPLE AND COMPACT FILTERING DIELECTRIC RESONATOR ANTENNA

CROSS REFERENCE TO RELATED APPLICATIONS

The present application claims the benefit of Chinese Patent Application No. 201810421269.5 filed on May 4, 2018. All the above are hereby incorporated by reference.

FIELD OF THE INVENTION

The present application relates to a technical field of a dielectric resonator antenna, and more particularly relates to a simple and compact filtering dielectric resonator antenna.

BACKGROUND OF THE INVENTION

With a rapid development of wireless communications, modern communication systems have put forward high requirements for antenna miniaturization, wide frequency band, low loss and other performance. Although microstrip antennas have received in-depth research and extensive applications because of their low profile, light weight, etc., due to high metal ohmic losses at high frequencies and large antenna geometries at low frequencies, which are two key technical bottlenecks, its development and application have been limited. In recent years, the dielectric resonator antenna, which is a new type of antennas, has been widely concerned and studied due to its good performance such as low loss and small sizes.

In mobile communications, it is increasingly popular to integrate a bandpass filter and an antenna into a single module to reduce system size and insertion loss. However, in order to guarantee the filtering performance and radiation performance, the existing dielectric resonator antenna is often complicated in structure, and it is difficult to meet the demand of miniaturization.

SUMMARY OF THE INVENTION

In order to solve the above problems of the prior art, embodiments of the present invention provide a simple and compact filtering dielectric resonator antenna. The technical solution is as follows:

In one aspect, an embodiment of the present invention provides a simple and compact filtering dielectric resonator antenna comprising:

A ground plane, a dielectric substrate defined on the ground plane, a dielectric resonator defined on the dielectric substrate, and a hybrid feeding line, therein the hybrid feeding line is applied for increasing the bandwidth of the filtering dielectric resonator antenna and forming cross-coupling paths in the dielectric resonator so that radiation nulls are produced at edges of radiation passband to achieve a filtering response for the filtering dielectric resonator antenna.

In the filtering dielectric resonator antenna according to the embodiment of the present invention, the hybrid feeding line comprises: a microstrip line and a metallic conformal strip, and the microstrip line comprises: a microstrip main branch defined on the dielectric substrate, and a first microstrip stub and a second microstrip stub which are extending from one end of the microstrip main branch, one end of the metallic conformal strip is connected to the microstrip main branch.

In the filtering dielectric resonator antenna according to the embodiment of the present invention, the first microstrip stub and the second microstrip stub are arranged in parallel and are both defined at the bottom of the dielectric resonator, the length of the first microstrip stub is not equal to the length of the second microstrip stub, and the metallic conformal strip is attached on a sidewall of the dielectric resonator.

In the filtering dielectric resonator antenna according to the embodiment of the present invention, the first microstrip stub is shorter than the second microstrip stub, and the metallic conformal strip and the first microstrip stub jointly produce a radiation null at the upper edge of the passband.

In the filtering dielectric resonator antenna according to the embodiment of the present invention, the first microstrip stub is shorter than the second microstrip stub, and the metallic conformal strip and the second microstrip stub cooperatively produce a radiation null at the lower edge of the passband.

In the filtering dielectric resonator antenna according to the embodiment of the present invention, the length of the first microstrip stub ranges from $0.15\lambda_0$ to $0.3\lambda_0$, and the length of the second microstrip stub ranges from $0.3\lambda_0$ to $0.5\lambda_0$, where $\lambda_0$ is a guided wavelength corresponding to a center frequency of the filtering dielectric resonator antenna.

In the filtering dielectric resonator antenna according to the embodiment of the present invention, the dielectric resonator is produced by a dielectric resonator having a rectangle cross section or circular cross section.

In the filtering dielectric resonator antenna according to the embodiment of the present invention, the dielectric resonator is produced by a dielectric resonator having a square cross section.

In the filtering dielectric resonator antenna according to the embodiment of the present invention, the microstrip line is defined on the central axis of the bottom of the dielectric resonator, and the metallic conformal strip is defined on the central axis of the sidewall of the dielectric resonator.

The implementation of the filtering dielectric resonator antenna provided by the present invention has following beneficial effects:

In the embodiment of the present invention, the use of a hybrid feeding line in a dielectric resonator antenna, that is, the dielectric resonator antenna with a hybrid feeding line comprising a first microstrip stub, a second microstrip stub, and a metallic conformal strip can not only enhance the impedance bandwidth of the passband (stable unidirectional radiation within a bandwidth of 22% when the dielectric constant of the dielectric resonator is 9.5), but also produce two radiation nulls near the edges of the passband. Both good filtering and radiating performances are therefore obtained without needing extra filtering circuit, giving a very compact structure.

BRIEF DESCRIPTION OF THE DRAWINGS

In order to clearly illustrate the technical solutions in embodiments of the present invention, drawings used in the description of the embodiments will be briefly described below. Obviously, the drawings in the following description are merely some embodiments of the present invention. For a person skilled in the art, other drawings may also be obtained based on the drawings without any creative work.

DETAILED DESCRIPTION OF THE PREFERRED EMBODIMENT

To make a technical feature, objective and effect of the present application be understood more clearly, now a specific implementation of the present application is described in detail with reference to accompanying drawings and embodiments. The drawings show preferred embodiments of the invention. However, the present invention can be implemented in many different forms and is not limited to the embodiments described herein. Rather, these embodiments are provided so that this disclosure is thorough and complete.

Embodiment One

Figure 1:
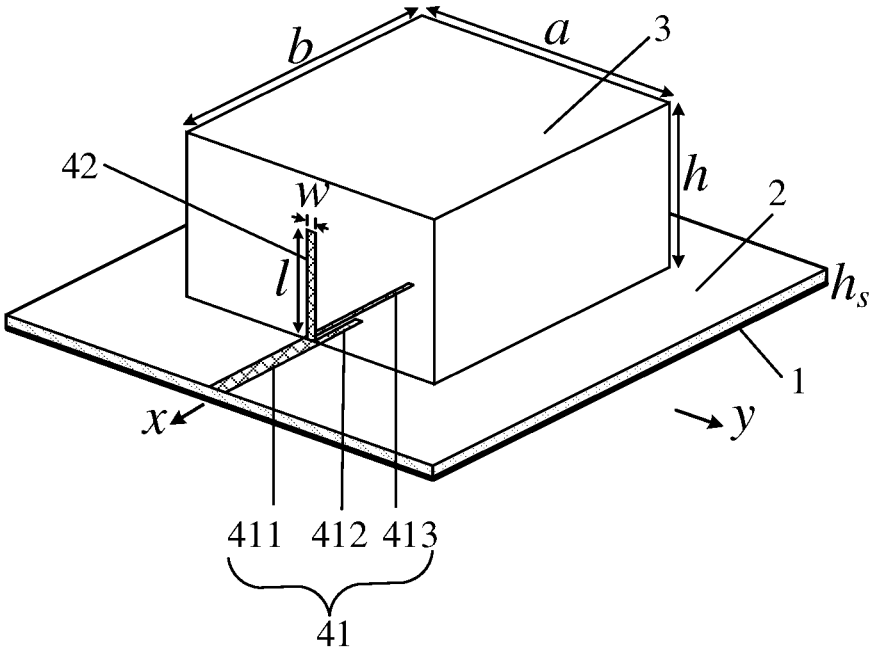
FIG. 1 is a schematic structural diagram of a simple and compact filtering dielectric resonator antenna according to an embodiment of the present invention.

An embodiment of the present invention provides a simple and compact filtering dielectric resonator antenna, referring to FIG. 1, comprising: a ground plane 1, a dielectric substrate 2 defined on the ground plane 1, a dielectric resonator 3 defined on the dielectric substrate 2, and a hybrid feeding line 4 (see FIG. 2), therein the hybrid feeding line 4 is applied for increasing bandwidth of the filtering dielectric resonator antenna and forms cross-coupling paths in the dielectric resonator 3 so that radiation nulls are produced at edges of radiation passband to achieve a filtering response for the filtering dielectric resonator antenna.

Figure 2:
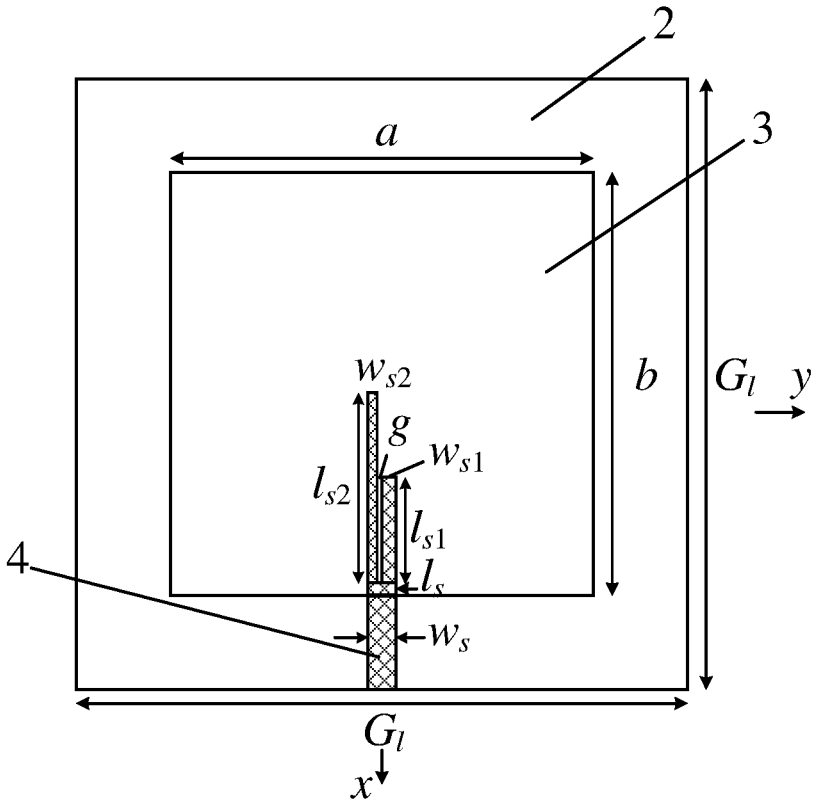
FIG. 2 is a schematic structural top view of a simple and compact filtering dielectric resonator antenna according to the embodiment of the present invention.

Specifically, referring to FIGS. 1-2, the hybrid feeding line 4 may comprise a microstrip line 41 and a metallic conformal strip 42. The microstrip line 41 comprises: a microstrip main branch 411 defined on the dielectric substrate 2, and a first microstrip stub 412 and a second microstrip stub 413 which are extending from one end of the microstrip main branch 411, and one end of the metallic conformal strip 42 is also connected to the microstrip main branch 411. The hybrid feeding line 4 not only increases the antenna bandwidth but also achieves the filtering function.

In the embodiment, a hybrid feeding line is used in the dielectric resonator antenna. Due to different loading effects of microstrip stubs (i.e., the first microstrip stub and the second microstrip stub) and the metallic conformal strip, the resonance frequency of the fundamental mode of the dielectric resonator antenna excited by two microstrip stubs and the metallic conformal strip is slightly different from each other. Three stepping resonances yield a wide bandwidth of 21.9% and a very flat gain of 5.1 dBi. The hybrid feeding line also establishes two cross-coupled routes in the dielectric resonator antenna, which introduces two radiation nulls on both sides of the passband. That is, the dielectric resonator antenna achieves not only enhanced impedance bandwidth, but also two radiation nulls near band-edges. Therefore, it can obtain well filtering and radiating performances without any additional filtering circuits.

Alternatively, referring to FIG. 1 and FIG. 2, the first microstrip stub 412 and the second microstrip stub 413 are defined in parallel and are both defined at the bottom of the dielectric resonator 3. The length of the first microstrip stub 412 is not equal to the length of the second microstrip stub 413, and the metallic conformal strip 42 is attached on a sidewall of the dielectric resonator 3.

It should be noted that the lengths of the first microstrip stub 412 and the second microstrip stub 413 are not equal. In FIGS. 1-2, the first microstrip stub 412 is shorter than the second microstrip stub 413. In practical implements, it may also be that the first microstrip stub 412 is longer than the second microstrip stub 413, and it is not limited herein.

Alternatively, referring to FIG. 1, the first microstrip stub 412 is shorter than the second microstrip stub 413. The metallic conformal strip 42 and the first microstrip stub 412 jointly produce a radiation null at the upper edge of the passband, improving frequency selectivity. The metallic conformal strip 42 and the second microstrip stub 413 cooperatively produce radiation null at the lower edge of the passband, improving frequency selectivity.

Alternatively, in order to facilitate an extension to the dual-polarized design, referring to FIGS. 1-2, the dielectric resonator 3 may be produced by a dielectric resonator having a rectangle or circular cross-section.

Alternatively, referring to FIGS. 1-2, the dielectric resonator 3 may be produced by a dielectric resonator having a square cross-section.

Alternatively, referring to FIGS. 1-2, the microstrip line 41 is defined on the central axis of the bottom of the dielectric resonator 3, and the metallic conformal strip 42 is defined on the central axis of the sidewall of the dielectric resonator 3.

Alternatively, the length of the first microstrip stub 412 ranges from $0.15\lambda_0$ to $0.35\lambda_0$, and the length of the second microstrip stub 413 ranges from $0.3\lambda_0$ to $0.5\lambda_0$, $\lambda_0$ is a guided wavelength corresponding to the center frequency of the filtering dielectric resonator antenna.

Figure 3:
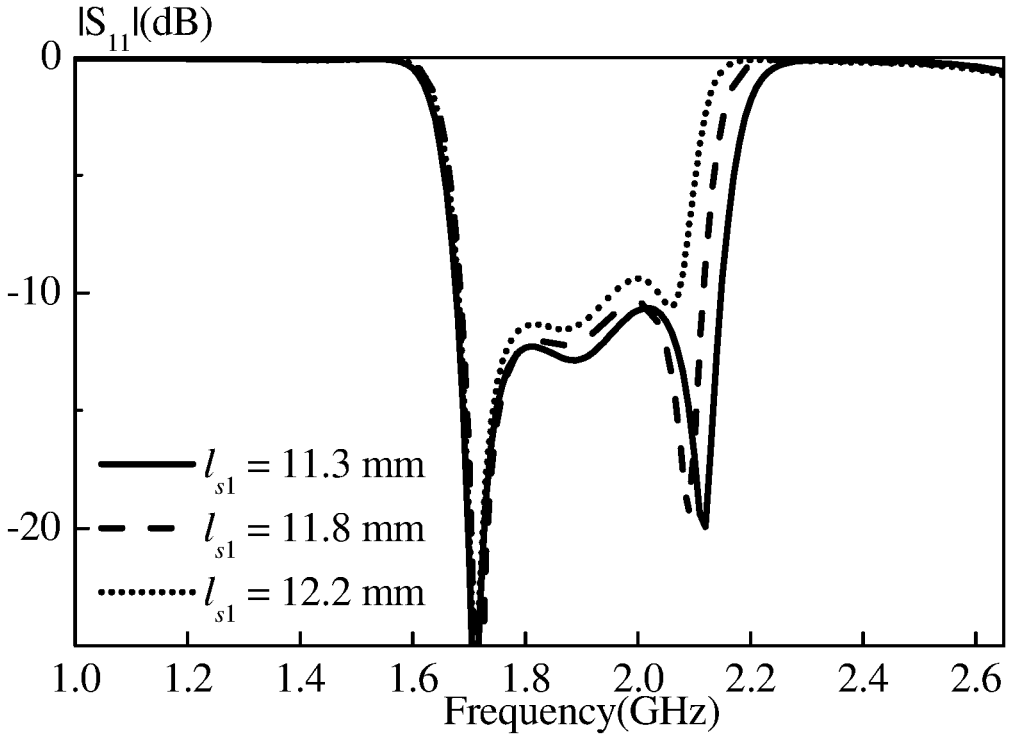
FIG. 3 is a schematic diagram showing simulated reflection coefficients of a filtering dielectric resonator antenna with different lengths of a first microstrip stub according to the embodiment of the present invention.
Figure 4:
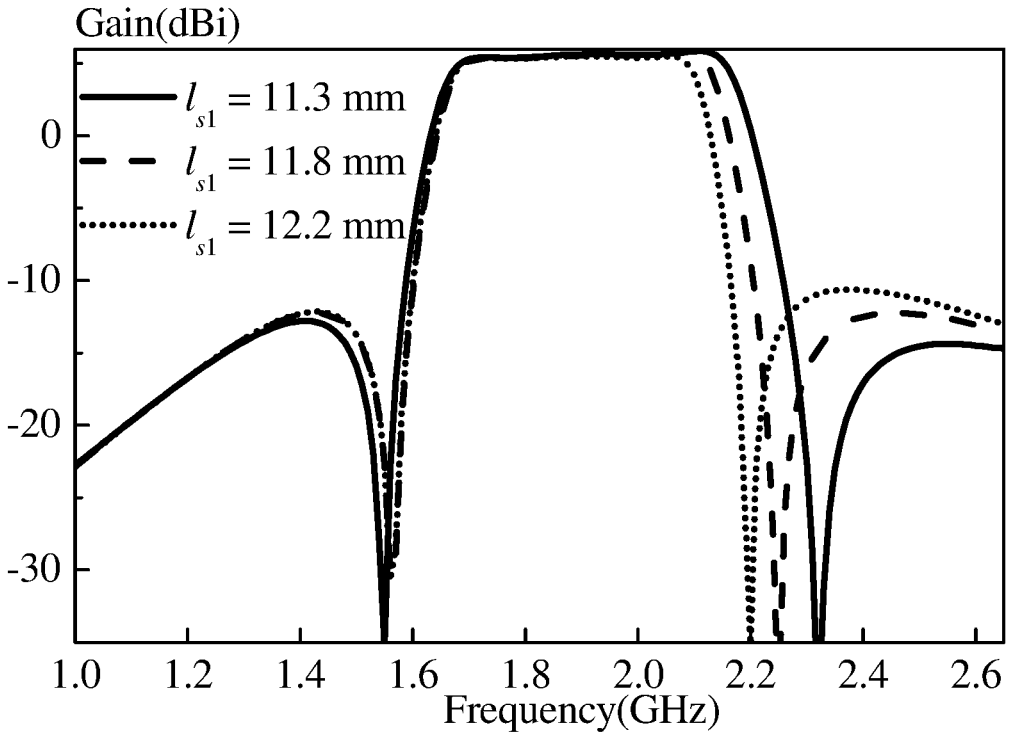
FIG. 4 is a schematic diagram illustrating simulated gains of a filtering dielectric resonator antenna with different lengths of a first microstrip stub according to the embodiment of the present invention.
Figure 5:
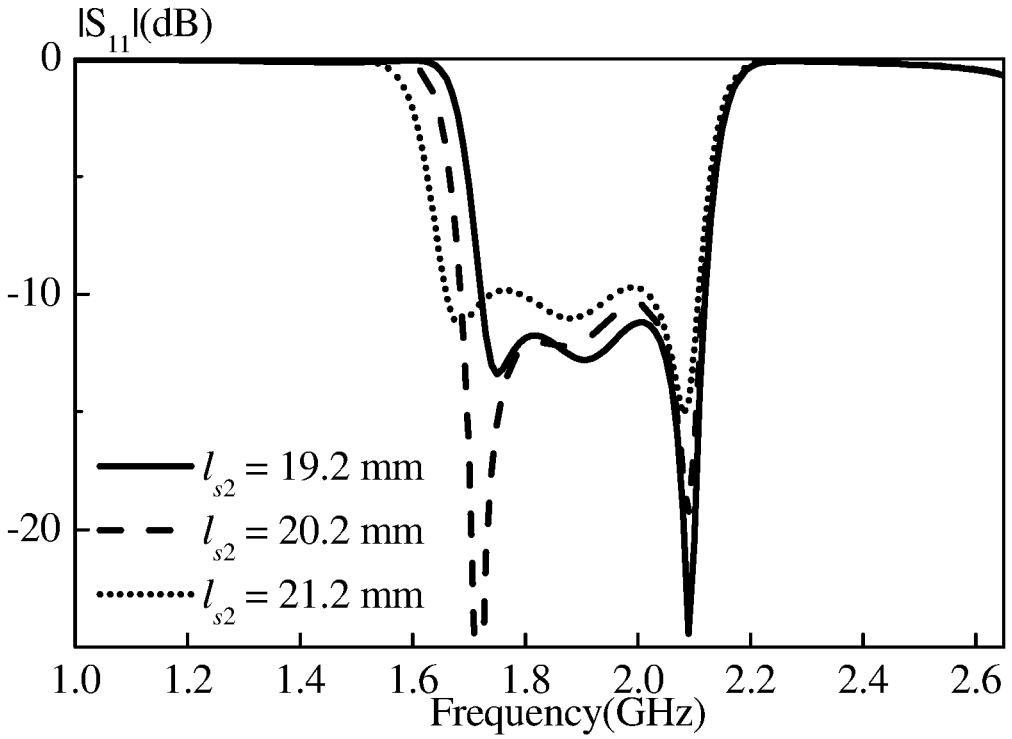
FIG. 5 is a schematic diagram showing simulated reflection coefficients of a filtering dielectric resonator antenna with different lengths of a second microstrip stub according to the embodiment of the present invention.
Figure 6:
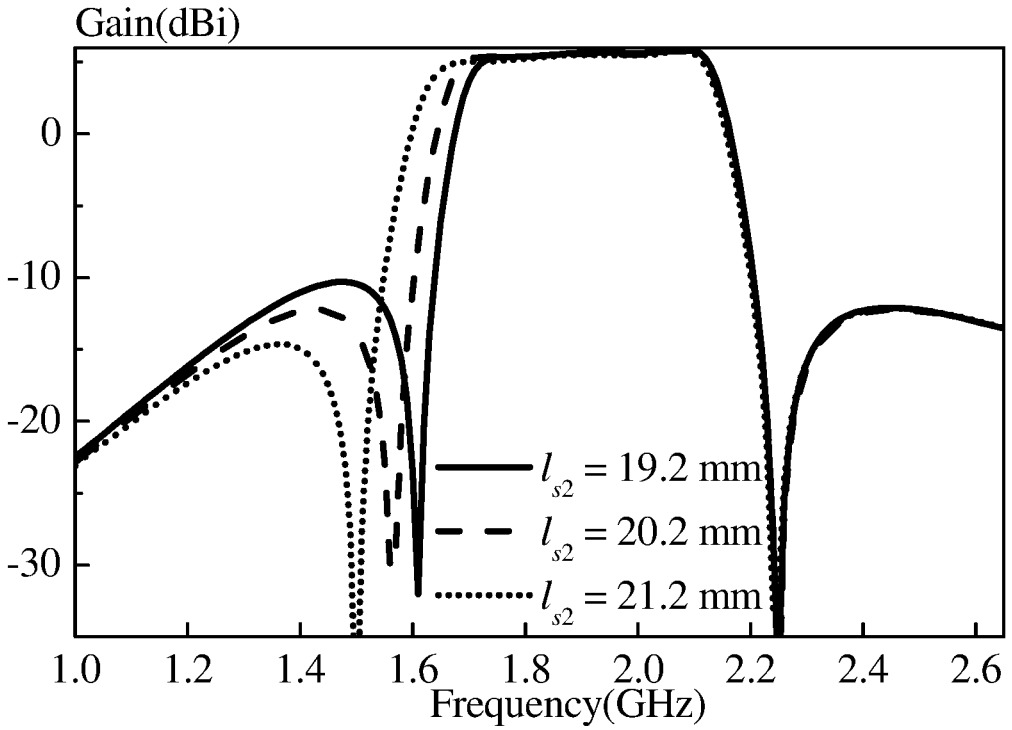
FIG. 6 is a schematic diagram illustrating simulated gains of a filtering dielectric resonator antenna with different lengths of a second microstrip stub according to the embodiment of the present invention.

In the present embodiment, referring to FIGS. 3-6, in FIGS. 3-4, different lengths of a first microstrip stub 412 are utilized in a filtering dielectric resonator antenna, and reflection coefficients which can be shown as $|S_{11}|$ are simulated in FIG. 3. In FIG. 5 and FIG. 6, different lengths of a second microstrip stub 413 are utilized in a filtering dielectric resonator antenna, and reflection coefficients and gains are simulated. It can be seen that the appropriate selection of lengths of microstrip stubs can effectively control the radiation nulls of upper and lower band-edges, and then the roll-off rate of the edges of the passband can be flexibly adjusted to improve the frequency selectivity; in addition, adjusting the lengths of microstrip stubs can also move the resonant mode, which in turn can control the bandwidth of the antenna.

Preferably, when the center frequency is 1.9 GHz, the dielectric resonator 3 has a length of 45 mm which is shown as a in FIG. 1, a width of 45 mm which is shown as b in FIG. 1, and a height of 17.5 mm which is shown as h in FIG. 1, dielectric constant of the dielectric resonator 3 is 9.5. The length of the first microstrip stub 412 is 11.8 mm which is shown as $l_{s1}$ in FIG. 2, and the width of the first microstrip stub 412 is 0.9 mm which is shown as $w_{s1}$ in FIG. 2. The length of the second microstrip stub 413 is 20.2 mm which is shown as $l_{s2}$ in FIG. 2 while the width of the second microstrip stub 413 is 0.4 mm which is shown as $w_{s2}$ in FIG. 2. The length of the metallic conformal strip 42 is 17 mm which is shown as l in FIG. 1, and the width of the metallic conformal strip 42 is 0.1 mm which is shown as w in FIG. 1.

Figure 7:
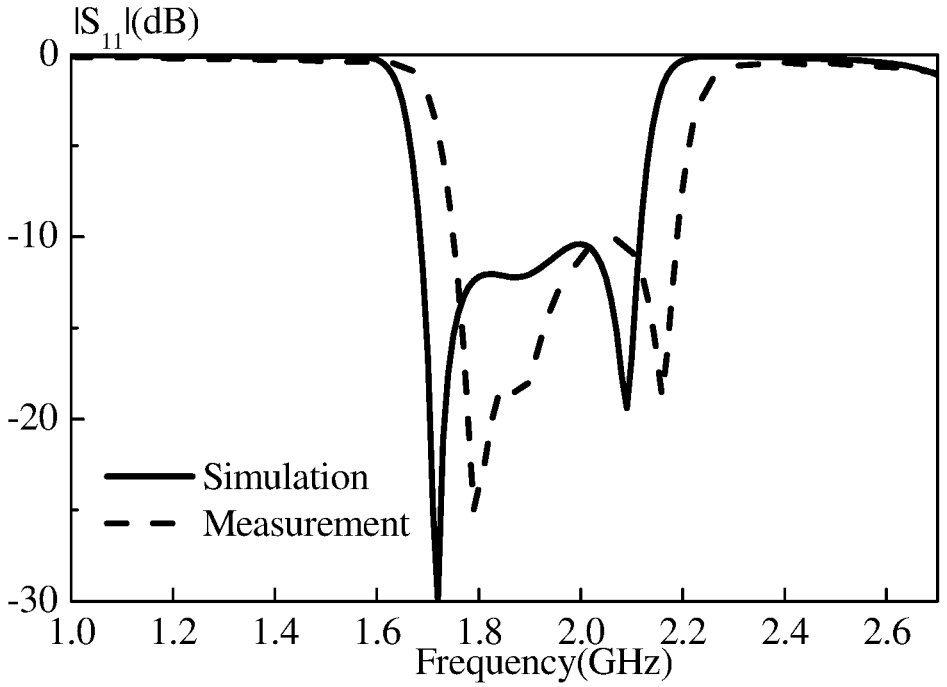
FIG. 7 is a schematic diagram showing simulated and measured reflection coefficients of a simple and compact filtering dielectric resonator antenna operating at 1.9 GHz according to the embodiment of the present invention.
Figure 8:
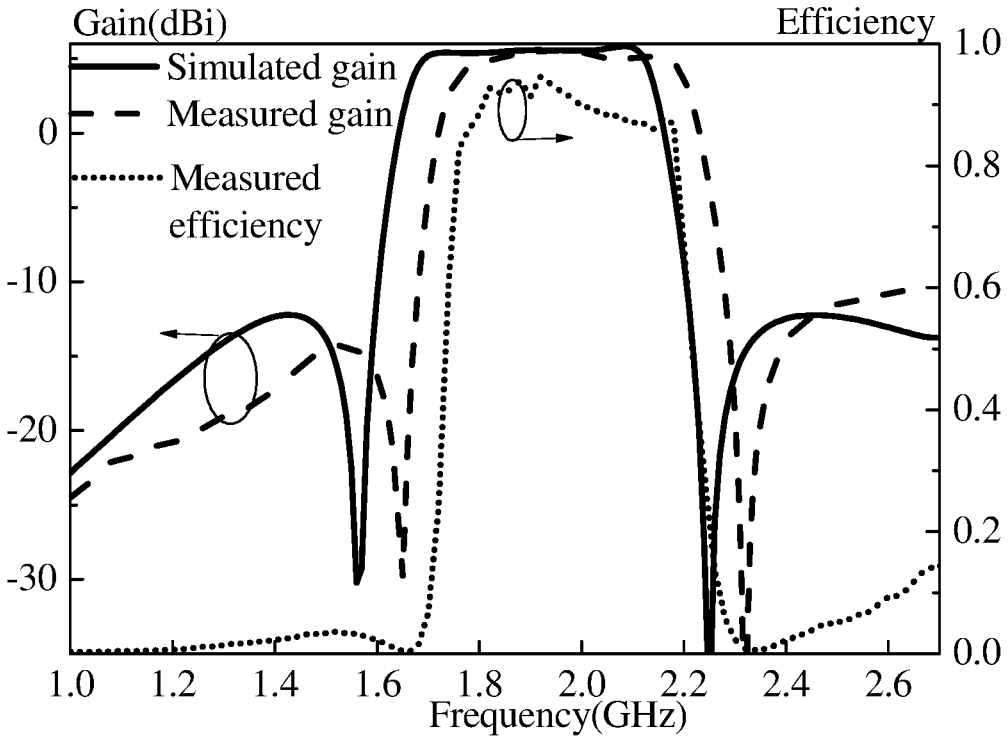
FIG. 8 is a schematic diagram showing simulated and measured gains and efficiencies of a simple and compact filtering dielectric resonator antenna operating at 1.9 GHz according to the embodiment of the present invention.
Figure 9:
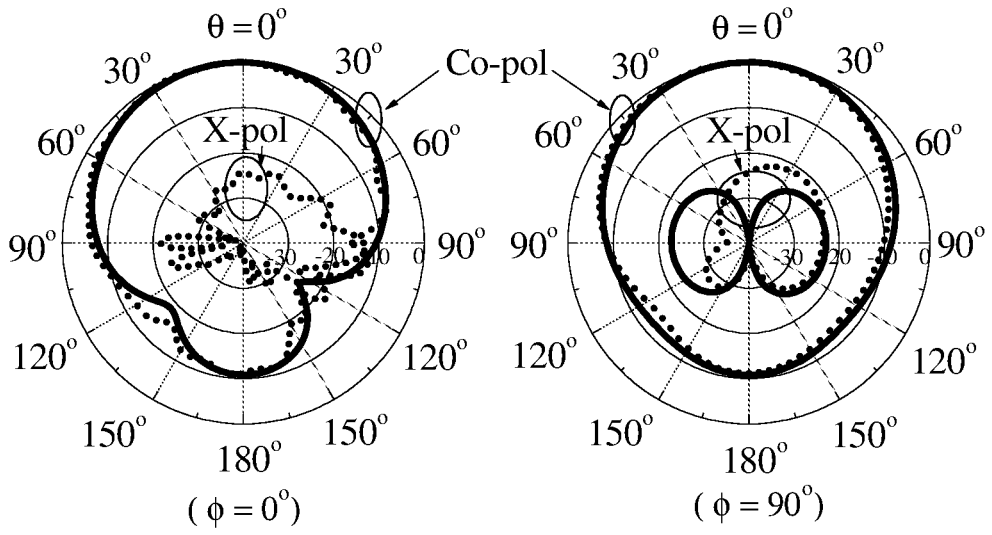
FIG. 9 is a diagram of simulated and measured radiation patterns at the center frequency of a simple and compact filtering dielectric resonator antenna according to the embodiment of the present invention.

In addition, FIGS. 7-9 show simulated and measured results of the simple and compact filtering dielectric resonator antenna described above, the measured results are based on measurement of a prototype of the filtering dielectric resonator antenna prepared as the preferred sizes described above. FIG. 7 shows simulated and measured reflection coefficients of the simple and compact filtering dielectric resonator antenna; FIG. 8 shows simulated and measured gains of the simple and compact filtering dielectric resonator antenna; FIG. 9 shows radiation patterns at the center frequency 1.9 GHz. In FIGS. 7-9, discrepancy between simulated and measured results of the simple and compact filtering dielectric resonator antenna of the present application is within a reasonable range (a deviation is mainly caused by the gap between the dielectric resonator and the dielectric substrate, and a machining deviation of the dielectric resonator), it has reliable practicality, which means that it can be implemented. In addition, the filtering dielectric resonator antenna exhibits well filtering and radiating characteristics at the same time. The measured impedance bandwidth is 21.9%, the reflection coefficient curves in the lower and upper stopbands are flat and close to 0 dB. Also, sharp band-edges are obtained between the passband and stopbands, showing well frequency selectivity. The gain curve in the passband is flat, with an average gain of 5.1 dB. There are two radiation nulls generated at 1.65 GHz and 2.31 GHz, right near two sides of the passband, showing sharp band-edges. An out-of-band suppression of more than 16 dB can be observed within the stopband from 1 to 2.7 GHz. The measured efficiency is about 90% within the passband and lower than 0.9% at the radiation null frequencies. In the boresight direction, the co-polarization is 25 dB greater than the cross polarization. The length of the ground plane of the embodiment is 0.44 times wavelength in vacuum at the center frequency. Increasing the dimension of the ground plane can improve the front-to-back ratio of the radiation patterns.

Figure 10:
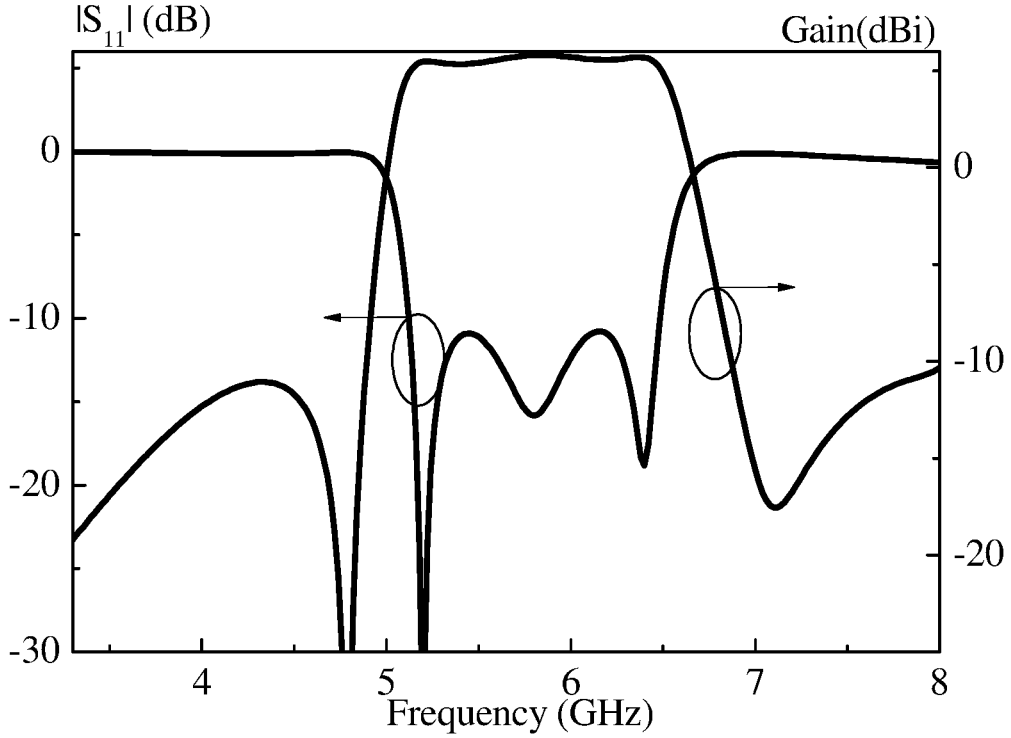
FIG. 10 is a schematic diagram of simulated reflection coefficients and gains of a filtering dielectric resonator antenna operating at 5.8 GHz and a preferred size provided in the embodiment of the present invention.

In addition, referring to FIG. 10, FIG. 10 shows a simulated reflection coefficient and gain of the filtering dielectric resonator antenna at the center frequency 5.8 GHz and following preferred dimensions: a=b=14.7 mm, h=5.7 mm, l=5.6 mm, w=0.1 mm, $w_s$=0.6 mm, $l_s$=0.65 mm, $l_{s1}$=6.5 mm, $w_{s1}$=0.13 mm, $l_{s2}$=3.8 mm, $w_{s2}$=0.29 mm, g=0.1 mm, $h_s$=0.203 mm, and $G_l$=23 mm. As can be seen from FIG. 10, the filtering dielectric resonator antenna has well filtering and radiation performances. It should be noted that $l_s$ is the length of one end of the microstrip main branch 411 extending into the bottom of the dielectric resonator 3, and g is the gap width between the first microstrip stub 412 and the second microstrip stub 413, $G_l$ is the length and width of the dielectric substrate 2 (the cross section of the dielectric substrate 2 is square), $h_s$ is the total thickness of the ground plane 1 and the dielectric substrate 2.

In the embodiment of the present invention, a hybrid feeding line is used in a dielectric resonator antenna, that is, the dielectric resonator antenna with a hybrid feeding line comprising a first microstrip stub, a second microstrip stub, and a metallic conformal strip can not only enhance the impedance bandwidth of the passband (stable unidirectional radiation within a bandwidth of 22% when the dielectric constant of the dielectric resonator is 9.5), but also produce two radiation nulls near the edges of the passband. Both good filtering and radiating performances are therefore obtained without needing extra filtering circuit, giving a very compact structure.

The foregoing descriptions are merely preferred embodiments of the present invention and are not intended to limit the present invention. Any modifications, equivalent replacements and improvements made within the spirit and principle of the present invention shall be comprised in the protection of the present invention.

The invention claimed is:

1. A simple and compact filtering dielectric resonator antenna comprising:

a ground plane, a dielectric substrate defined on the ground plane, a dielectric resonator defined on the dielectric substrate, and a hybrid feeding line;

wherein the hybrid feeding line is applied for increasing a bandwidth of the filtering dielectric resonator antenna and forming cross-coupling paths in the dielectric resonator so that radiation nulls are produced at edges of radiation passband to achieve a filtering response for the filtering dielectric resonator antenna;

wherein the hybrid feeding line comprises a microstrip line and a metallic conformal strip, the microstrip line comprises: a microstrip main branch defined on the dielectric substrate, and a first microstrip stub and a second microstrip stub which are extending from one end of the microstrip main branch, and one end of the metallic conformal strip is connected to the microstrip main branch;

wherein the first microstrip stub and the second microstrip stub are defined in parallel and are both defined at a bottom of the dielectric resonator and the metallic conformal strip is attached on a sidewall of the dielectric resonator;

wherein the first microstrip stub is shorter than the second microstrip stub, the metallic conformal strip and the first microstrip stub jointly produce a radiation null at an upper edge of the radiation passband, the metallic conformal strip and the second microstrip stub cooperatively produce another radiation null at a lower edge of the radiation passband.

2. The filtering dielectric resonator antenna according to claim 1, wherein the length of the first microstrip stub ranges from $0.15\lambda_0$ to $0.35\lambda_0$, and the length of the second microstrip stub ranges from $0.3\lambda_0$ to $0.5\lambda_0$wherein $\lambda_0$ is a guided wavelength corresponding to a center frequency of the filtering dielectric resonator antenna.

3. The filtering dielectric resonator antenna according claim 1, wherein the dielectric resonator is produced by a dielectric resonator having a square cross-section.

4. The filtering dielectric resonator antenna according claim 3, wherein the microstrip line is defined on a central axis of the bottom of the dielectric resonator, and the metallic conformal strip is defined on the central axis of the sidewall of the dielectric resonator.

* * * * *